US005558618A

United States Patent [19]

Maniglia

[11] Patent Number: 5,558,618

[45] Date of Patent: Sep. 24, 1996

[54] SEMI-IMPLANTABLE MIDDLE EAR HEARING DEVICE

[76] Inventor: Anthony J. Maniglia, 14450 County Line Rd., Hunting Valley, Ohio 44022

[21] Appl. No.: 376,750

[22] Filed: Jan. 23, 1995

[51] Int. Cl.[6] ..... H04R 25/00

[52] U.S. Cl. ..... 600/25

[58] Field of Search ..... 600/25; 606/55–57; 181/128–137

[56] References Cited

U.S. PATENT DOCUMENTS 3,870,832 3/1975 Fredrickson ..... 600/25

5,015,224 5/1991 Maniglia ..... 600/25

*Primary Examiner*—Angela D. Sykes

*Assistant Examiner*—John P. Lacyk

*Attorney, Agent, or Firm*—Vytas R. Matas

[57] ABSTRACT

An improved partially implantable hearing device has a high coercivity permanent target magnet mounted to the ossicular chain by METABOND adhesive and being driven by an air core driving coil optimally implanted in a contactless manner at a spacing of approximately 1 mm. therefrom. The drive coil responds to auditory vibrations sensed by an externally concealed unit which converts these signals to an electrical signal transmitted to an externally located antenna which transmits same to an internally mounted antenna electronically connected to the air core electromagnetic driving coil.

19 Claims, 18 Drawing Sheets

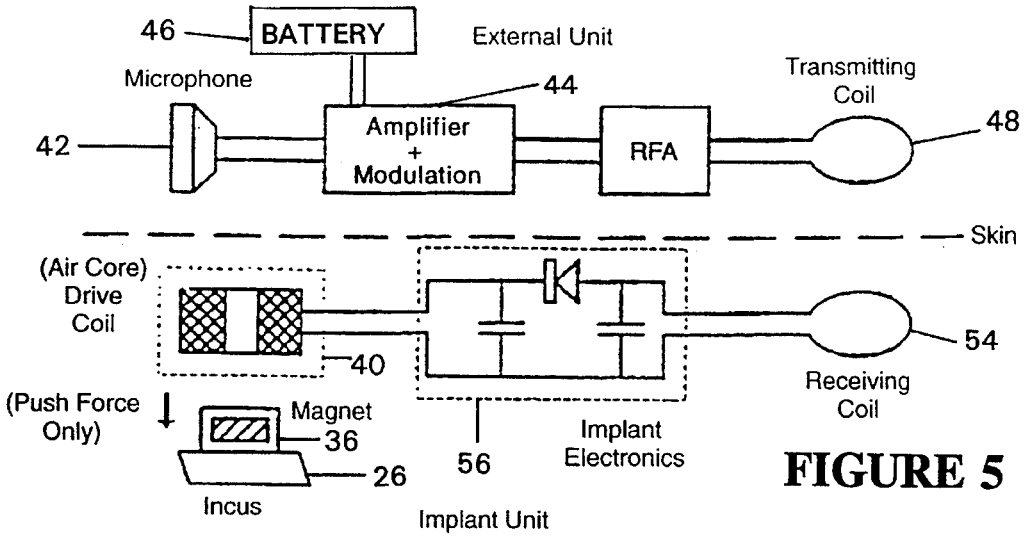
FIGURE 5
FIGURE 6
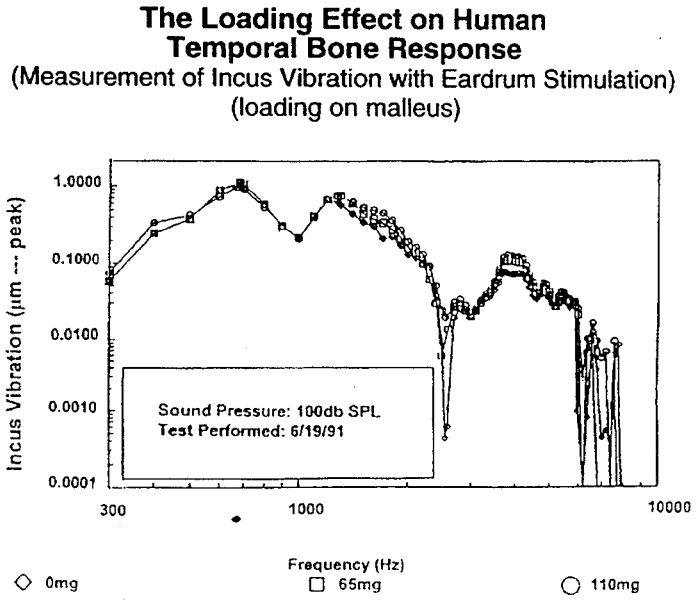

SEMI-IMPLANTABLE MIDDLE EAR HEARING DEVICE

BACKGROUND OF THE INVENTION

1. Field of the Invention

The present invention relates to partially implantable hearing devices generally and particularly to such devices which use electromagnetic drivers and target permanent magnets to stimulate the ossicular chain of the middle ear.

2. Description of the Prior Art

Conventional prior art hearing aid is composed of a microphone, an amplifier, a battery as a power source, and a speaker or earphone (commonly referred to as a receiver in the hearing aid industry). The implantable hearing device has the same basic components, except that the speaker is replaced by a driving vibrating component, such as an electromagnetic coil or a piezoelectric system of bimorph design. Environmental sound energy, as it passes through either device, is converted by the microphone into an electrical signal which is routed to an amplifier. In the conventional hearing aid, the speaker transduces the amplified electrical signals into acoustic energy, which is then transmitted to the tympanic membrane and ossicular chain. In the implantable middle ear hearing device, the speaker is eliminated, being replaced by the vibratory component which drives the ossicular chain.

In 1987, Hough et al. reported on a middle ear implantable hearing device using electromagnetic principles applied to humans undergoing middle ear surgery under local anesthesia. Although the device was functional, its electrical power consumption was excessive.

Ko, Maniglia and Zhang also reported, in 1987, their experience with an electromagnetic middle ear hearing devices using direct stimulation of the stapes. Furthermore, Maniglia et. al. have done extensive experiments in this field involving animals such as cats and rabbits as well as preserved and fresh human temporal bones. Goode, et al. have experimented with a piezoelectric system to produce stapes vibration in fresh human temporal bones. Heide, et al. in 1988 presented the advantages of an electromagnetic hearing aid in the ear canal driving a magnet glued to the ear drum. Finally, Goode has recently reported encouraging results with another design in which another electromagnetic canal device similar in principle and design that stimulates a samarium cobalt magnet attached to a silicone mold which is fitted on the ear drum with mineral oil. This is known as an EAR LENS system of attachment or gluing to the ear drum. However, the magnet glued to the ear drum only stays in place temporarily, and a better system of adhering is necessary.

Totally concealed, partially implantable middle ear hearing device are also known. These devices are described in U.S. Pat. Nos. 4,957,478 and 5,015,224 issued to Anthony J. Maniglia and have a replaceable outer ear canal unit and an implanted magnet attached to the ossicles of the middle ear specifically the handle of the malleus. The replaceable ear canal unit receives acoustic energy or sound waves that enter the ear and travel down the outer ear canal to the unit. A microphone detects the sound waves and, with the help of a battery and an electronic amplifier, transforms the sound waves into amplified electrical signals. The electrical signals activate an electromagnetic driving coil, i.e., a coil of wire wrapped around a ferrite alloy core, which creates a magnetic field that varies in response to the sound waves detected by the microphone. The magnetic field created by the electromagnetic coil interacts with the magnetic field created by the magnet, generating a force which vibrates the target magnet and the malleus bone to which it is attached. To insure that the target magnet is securely attached to the malleus bone, the titanium case has a self tapping mini-screw to be inserted into a man-made micro cavity created in the malleus bone. Once the screw is inserted into the malleus bone, it is allowed to osseo-integrate for a three month period. After this period of time, the replaceable outer ear canal unit is put into use. The magnet would weight about 30 to 35 mg and the distance between this magnet and the external ear canal unit would be 3 to 5 mm.

Another variation of this system consists of placing the magnet encased in a titanium dish anchored to the lateral aspect of the incus. Two holes are made in the body of the incus. The titanium extension of the dish is secured to the incus by two self tapping screws introduced through the previously made holes.

In another variation of this system a totally concealed, partially implantable middle ear hearing device having a replaceable outer ear canal unit has means for generating radio frequency waves responsive to acoustic energy or sound waves that enter the ear and travel down the outer ear canal to the unit. Again, a microphone detects the sound waves and, with the help of a battery and an electronic amplifier, transforms the sound waves into amplified electrical signals. In this aspect, however, the amplified electrical signals are sent to an external induction coil or radio signal transmitting antenna to be converted into amplitude modulation (AM) radio frequency waves that are transmitted to an internal induction coil implanted under the skin in the outer ear canal wall. An implanted electromagnetic driving coil, connected to the internal induction coil, again creates a magnetic field that varies in response to the sound waves detected by the microphone. This magnetic field interacts with another magnetic field created by a magnet attached to a bone in the ossicular chain in the middle ear. This interaction causes a force which vibrates the magnet and the bone to which is it attached. In one case, the bone to which the magnet is attached is the stapes; in another case the magnet is attached to the incus; while in a third case there is an electromagnetic-mechanical system having a very thin metal diaphragm attached to a titanium coil spring secured to the incus body, using a self-tapping titanium screw introduced through a hole, KTP 532 laser made. In another design the titanium spring coil is attached to a cup-bumper which "sits" on the stapes head.

Still another variation of this device has a partially concealed, partially implantable hearing device having a replaceable hidden external unit adapted to be located externally and medially to an upper portion of a pinna of an ear, rather than being located inside the outer ear canal of the ear. A microphone detects the sound waves and, with the help of a battery, an electronic amplifier and an external induction coil, the sound waves are converted into amplitude modulation (AM) radio frequency type waves for transmission to an internal induction coil implanted under the skin behind the ear. An implanted electromagnetic driving coil, connected thereto, creates a magnetic field that varies in response to the sound waves detected by the microphone. The magnetic field created by a magnet attached to a bone in the ossicular chain in the ear interacts with the magnetic field created by the electromagnetic driving coil, causing the magnet and the bone to which it is attached to vibrate. Again, in one case, the bone is the stapes bone; in another case the bone is the incus; while in a third case the electromagnetic-mechanical system mentioned above is employed.

Several problems occur with the above described designs. First, the implantation of the magnet on the head of the stapes require disarticulation of the ossicular chain. The technique is very invasive and rather destructive, creating a conductive hearing loss. If the device were to malfunction for any reason, a maximum air-bone gap would occur, because the conductive hearing loss component created by the disarticulation of the ossicular chain would be further aggravated by the load of the magnet on the head of the stapes. The clinical application for this proposed device is thus limited to patients with a conductive overlay or mixed hearing loss with erosion of the incus and ossicular discontinuity or absence of the incus and malleus. Thus, a device was needed that would be applicable to a much larger number of patients suffering from sensorineural hearing loss, which would avoid interruption of the ossicular chain and minimize invasive techniques in affixing the magnet on the ossicles.

To accomplish this goal an efficient, biocompatible, adhesive type of cement was needed to affix the magnet assembly on the body of the incus. Also, the existing magnets were found to have coercivity factors which necessitated a large size to effect the needed power to provide the necessary hearing boost. This not only made the adhesion difficult but added mass to the ossicular chain. Thus a small, lightweight high coercivity magnet was needed to make the electromagnetic device work efficiently.

BRIEF SUMMARY OF THE INVENTION

The present invention solves the problems associated with prior art electromagnetic partially implantable middle ear hearing devices as well as other problems by providing a device which has a small, lightweight high coercivity magnet effectively glued to the ossicular chain by a biocompatible bonding material METABOND or SUPERBOND adhesives manufactured in the USA and Japan respectively. The magnet is driven by an air core electromagnetic coil optimally spaced from the target magnet at a 1 mm. distance. There is no contact between the air core coil and the target magnet.

The device has an external unit and an internal unit. The external unit receives, amplifies, and transmits sound energy as radio frequency signals. It consists of a microphone, a radio frequency (RF) amplifier, a transmitting antenna, and a battery. Using existing microchip technology, these components are miniaturized to a unit with dimensions of 10×10×5 mm without the battery. This allows the small external unit to be effectively concealed in a post auricular skin pocket and is easily placed and removed by the patient. The skin pocket functions to maintain the external and internal antennae in proper proximity and alignment for optimal RF signal transmission. Leaving the pocket open superiorly and partially open inferiorly allows the area to remain accessible to hygienic maintenance. Dehydrating agents such as alcohol may be easily applied with a cotton-tipped applicator, and the pocket may be dried with a hair dryer after regular showers and shampoos.

The internal unit consists of a receiving antenna, a titanium support, implanted electronics, an electromagnetic (EM) transducer (driving coil), and the high coercivity magnet. The electronics (diode and capacitor), driving coil, and magnet are hermetically sealed in a helium filled laser-welded titanium case. A glass-insulated feed-through attaches the electronics to polytetrafluoroethylene-coated platinum iridium or stainless steel wires of the receiving antenna. The precise alignment of the transmitting (external) and receiving (internal) antennae permits transcutaneous transfer of the amplitude-modulated (AM) radio frequency signal (3 to 8 $MH_z$). The implanted electronics function to receive the radio frequency signal that has been processed by the external electronics and to transform this energy into an audio frequency filed as input to the driving coil. The driving coil in turn creates a magnetic field, which activates the target magnet attached to the body of the incus. Through the ossicular chain, the vibrations are transmitted to the inner ear fluids, activating the organ of Corti.

The magnet used is a neodymium-iron-boron (NdFeB) permanent magnet in great coercive force and high flux density. The magnet, weighs 8.0 mg, is hermetically sealed in a laser-welded 6-mg titanium case containing a helium atmosphere. Two of such magnets are used, stacked on top of each other. On the basis of fresh human cadaver studies, the magnet-titanium assembly weight load of 65 mg and 110 mg has a negligible effect at the malleus and incus, respectively, on the frequency response.

The external electronics associated with the transducer are designed to apply only push forces on the magnet-incus assembly. An air-core coil placed in the attic of the middle ear is used because it does not exert a constant bias force on the ossicular chain. If the system is idling, there is no steady force applied to the incus-magnet assembly. In order to determine the size of the driving coil, 20 preserved human cadaver temporal bones were microsurgically dissected. Measurements were made of the mastoid cavity, antrum, attic, and body of the incus. Owing to the anatomic characteristics of the attic, the outside diameter of the driving coil assembled in a titanium case was limited to 5.0 to 6.0 mm. Initially, an efficient coil was built with a 3.0-mm outside diameter, 0.75-mm inside diameter, and a length of 1.0 mm, composed of 2200 turns of 52 AWG copper wire with 600 ohms resistance. A more efficient coil with 2668 turns of 52 AWG copper wire with 875 ohms resistant was later built for short-and long-term animal experimentation. Computer simulations were instrumental in the selection of this coil design. For the human device a coil with 3800 turns and a resistance of 1415 ohms is preferably used. This coil has been tested experimentally and found to generate 76% more force when compared to the 2620 turn coil.

In view of the foregoing it will be seen that one aspect of the present invention is to provide a high coercivity permanent magnet of small size and weight for mounting to the ossicular chain which will not interfere with the normal operation of the ossicular chain.

Another aspect of the present invention is to provide an effective biocompatible bond of the permanent magnet to the ossicular chain.

Yet another aspect of the present invention is to provide a casing for the magnet which will protect the magnet from corrosion and insure the life thereof as part of the implantable hearing device.

Still yet another aspect of the present invention is to provide a semi-implantable middle ear hearing device where the space between the target permanent magnet and the electromagnetic driver is maintained at an optimal distance of about 1 mm.

A yet further aspect of the present invention is to provide an electromagnetic driver for the target permanent magnet of the implantable hearing device which will not bias the permanent magnet and will only exert a push force thereon in response to auditory signals and where the counter action is due solely to the recoil of fibroelastic tissue of the ossicular chain and the ear drum.

These and other aspects of the present invention will be more fully understood after reviewing the following description of the preferred embodiment when considered with the appended drawings.

BRIEF DESCRIPTION OF THE DRAWINGS

FIG. 5 is a schematic of the externally and internally mounted electronics (diode and capacitor) of the FIG. 1 depiction.

FIG. 6 is a depiction of incus vibration vs. frequency for various loads on the ossicular chain showing the negligible effect of the permanent magnet of the present invention on the chain.

DETAILED DESCRIPTION OF THE PREFERRED EMBODIMENT

Figure 1:
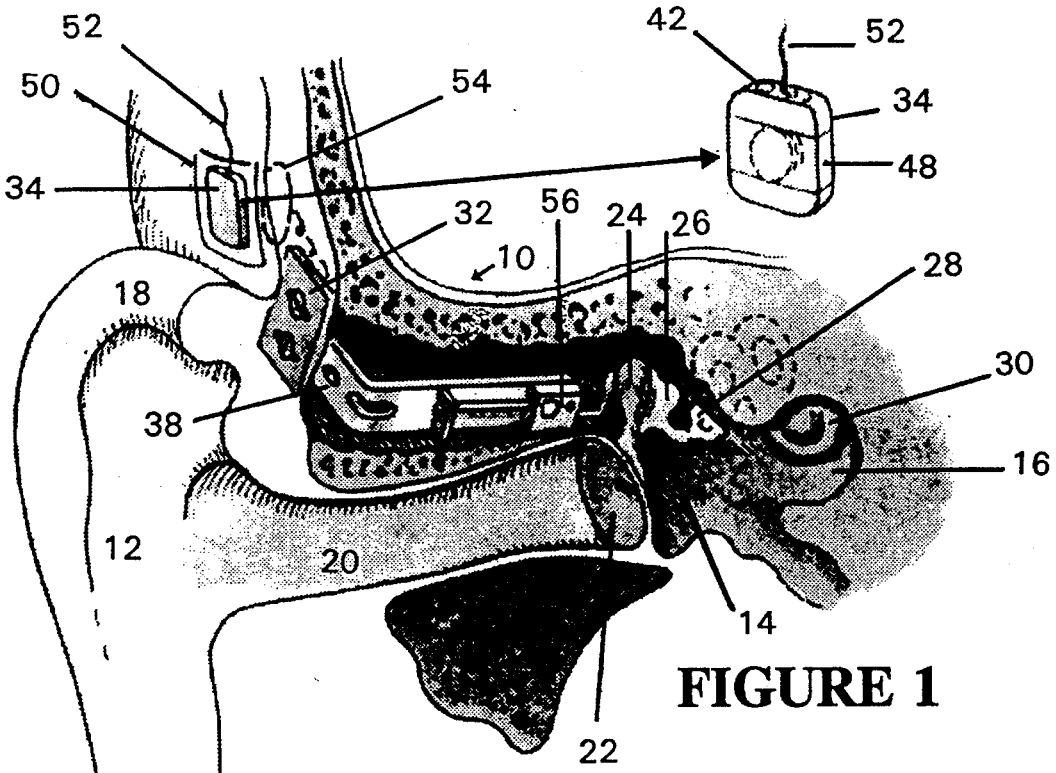
FIG. 1 is a depiction of a human ear having the partially implantable hearing aid of the present invention shown mounted therein.
Figure 2:
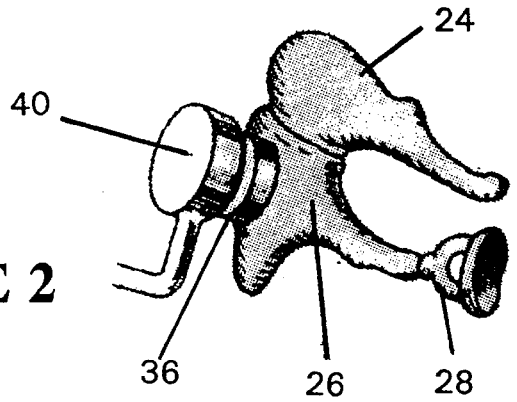
FIG. 2 is an expanded view of the electromagnet and permanent magnet locations in the FIG. 1 depiction.

Referring now to the drawings generally, wherein like numerals designate the same element throughout the several drawings, and to FIGS. 1. through 4 in particular, there are shown cross-sectional views of an ear, generally referred to as 10, which has received the partially implantable hearing device of the present invention.

The ear 10 is made up of an outer ear 12, a middle ear 14, and an inner ear 16. The outer ear 12 includes an auricle or pinna 18, and an outer ear canal 20. The pinna 18 collects acoustic energy or sound waves from the environment and directs them into the outer ear canal 20 which conveys the sound waves by air conduction to a tympanic membrane or ear drum 22, which separates the outer ear 12 from the middle ear 14.

The middle ear 14 contains a series of three tiny interconnected bones; the malleus (hammer) 24; the incus (anvil) 26; and the stapes (stirrup) 28. Collectively, these three bones are known as the ossicles or the ossicular chain. The malleus 24 is attached to the tympanic membrane 22 while the stapes 28, the last bone in the ossicular chain, is attached to the oval window of the inner ear (not shown).

Sound waves that travel down the outer ear canal 20, strike the tympanic membrane 22 and cause it to vibrate. The malleus 24, being connected to the tympanic membrane 22, is thus also set into motion, along with the incus 26 and the stapes 28. These three bones in the ossicular chain act as a set of levers to amplify the tiny vibrations received by the tympanic membrane 22. By the time the vibrations are transmitted to the oval window (not shown) the pressure vibrations received by the tympanic membrane 22 have been magnified by as much as 22 times. The stapes vibrates in turn, causing fluid in a spiral structure known as the cochlea 30 to move along its length. Very small hairlike cells (not shown) in the cochlea 30 are stimulated by the movement of fluid in the cochlea 30. There, hydraulic pressure displaces the inner ear fluid and mechanical energy in the hair cells is transformed into electrical impulses which are transmitted to neural pathways and the hearing center of the brain (temporal lobe), resulting in the perception of sound.

A first embodiment of the present invention is drawn to a partially concealed, partially implantable hearing device generally referred to as 32. The hearing device 32 has a replaceable, partially hidden external unit 34, and an implanted unit having a high coercivity permanent magnet assembly 36 bonded to the ossicular chain and a supporting structure 38 holding an air core electromagnetic coil 40 spaced approximately 0.5 to 1 mm. away from the permanent magnet assembly 36.

The external unit 34 is adapted to be located externally and medially to an upper portion of the pinna 18. The external unit 34 includes a microphone or transducer 42, an amplifier 44 and a power supply battery 46 and an external antenna 48 housed within the unit 34. Since the external unit 34 is not inserted into the outer ear canal, it need not be encased and hermetically sealed in a silicone mold as would be required for an implanted unit. The unit 34 is designed to be semi-implantable and the external unit well concealed in the postauricular area in a skin pocket hidden by the auricle. Such implanting is described in detail in U.S. Pat. Nos. 4,957,478 and 5,015,224. The reader is referred thereto for are explanation of the procedure and benefits of such concealed semi-implantations. An important advantage of the present design is that the air canal 20 is not plugged by any device that could very well cause irritation, infection, discomfort, or accumulation of wax. The ear canal is wide open, maintaining its normal anatomy and physiology without attenuation of sound or occlusion effect.

The external unit 34 receives, amplifies, and transmits sound energy as radio frequency signals. Using existing micro chip technology, the microphone 42, amplifier 44, battery 46 and antenna 48 can be miniaturized to a unit with dimensions of 10×10×5 mm without the battery. This small external unit can be effectively concealed in a postauricular skin pocket-50 and is easily placed and removed by the patient by pulling on the attached Nylon string 52. The skin pocket 50 functions to maintain the external antenna 48 and internal antenna 54, in proper proximity and alignment for optimal RF signal transmission. Leaving the pocket open superiorly and partially open inferiorly allows the area to remain accessible to hygienic maintenance. Dehydrating agents such as alcohol may be easily applied with a cotton-tipped applicator, and the pocket 50 may be dried with a hair dryer after regular showers and shampoos.

The internal unit 32 consists of receiving antenna 54 a titanium supporting shaft 38 implanted electronics 56 an electromagnetic (EM) transducer (driving coil), 40 and the target magnet 36. The electronics, driving coil, and target magnet are all hermetical sealed in laser-welded titanium cases. A glass-insulated Platinum feed-through post attaches by laser welding the electronics to polytetrafluoroethlene-coated platinum iridium or stainless steel wires of the receiving antenna 54. The precise alignment of the transmitting 48 and receiving 54 antennae, permits transcutaneous transfer of the amplitude-modulated (AM) radio frequency signal (3 to 8 $MH_z$). The implanted electronics function to receive the radio frequency signal that has been processed by the external electronics and to transform this energy into an audio frequency field as input to the driving coil. The driving coil in turn creates a magnetic field, which activates the target magnet attached to the body of the incus. Through the ossicular chain, the vibrations are transmitted to the inner ear fluids, activating the organ of Corti.

A neodymium-iron-boron (NdFeB) target permanent magnet is used because of its great coercive force and higher flux density. The target magnet, weighing 8.0 mg, is hermetically sealed in a laser-welded 6-mg titanium case containing a helium atmosphere to prevent corrosion of the magnet. On the basis of our fresh human cadaver studies depicted in FIG. 6. it is seen that the magnet-titanium assembly weight load of 65 mg. and 110 mg. has a negligible effect at the malleus and incus, respectively, on the frequency response. Our experiments with cats have shown that two magnets encased in Titanium(28 mg.) cause a hearing loss of only 5 db. SPL. An atticotomy is performed, and the NdFeB titanium encased magnet is attached to the incus. NdFeB is a permanent magnet with a coercive force (Hc) of 10.6 KOe as compared with samarium cobalt (SmCo5) which has an Hc of 7.5 KOe. Also, NdFeB has higher flux density (Br)per unit density. (NdFeB=1.86 KGauss: SmCo5=0.665 KGauss) and it has better machining properties. If not properly hermetically sealed, the iron will oxidize and the magnet will lose its strength. However, our NdFeB titanium-encapsulated magnet 36 is laser welded and hermetically sealed in a titanium case with a helium atmosphere. The titanium case can also be biointegrated in the incus with a post introduced in a hole created by a KTP laser or cemented on the incus body after light etching of the bone (titanium case with no post). A combination of both methods is also feasible. As was mentioned, the easiest, most efficient, and noninvasive way is just to cement it to the incus. The diameter of the encapsulated magnet is the same size s the width of the incus. Titanium is an excellent lightweight nonmagnetic biocompatable material, and it should not affect the viability of the incus. Another magnet can be stacked or cemented to the permanently fixed magnet in the incus with negligible reduction of tympanic membrane vibration.

One of the problems in mounting the magnet 36 to the incus was how to secure the titanium-encapsulated magnet without mechanically drilling into the incus. We experimented with micro drilling as well as the use of KTP and $Co_2$ lasers to create cavities that would allow a titanium post attached to the case of the magnet to be biointegrated into the body of the incus. We found that these techniques were very invasive and rather destructive. Further, they did not permit the tight mechanical fit into the drilled incus cavity required for the proper positioning of the magnet until the eventual osseus biointegration of the titanium post. This technique was not successful even when a spring was attached to the post to secure proper positioning in the incus cavity.

An efficient, biocompatible, adhesive type of cement was the best way to affix the titanium-magnet assembly on the body of the incus. There being no such adhesive available, I turned my attention to the dentistry literature in order to select a suitable cement that would satisfy my needs. A titanium-bone cement (METABOND adhesive) was found to secure the magnet to the incus. METABOND is the USA brand name for an adhesive of multiple compounds developed in Japan by Sun Medical Co. of Kyoto Japan where it is known as SUPERBOND adhesive. This adhesive is approved by the U.S. Food and Drug Administration (FDA) as a Class II dental device, #K900303, for cementing titanium to dentine; it has been subjected to previous biocompatability studies applicable to dentistry. Further research was then done by us to test the tensile strength and resistance to shear force and torque, using the rabbit as the animal model. Titanium disks were cemented with METABOND adhesive on the tibia of the rabbits after the tibia was etched with citric acid. Experiments in the rabbit after 3 months of implanatation have shown excellent results. Our conclusion was that METABOND adhesive was most effective and least invasive for binding titanium to bone. The results of chronic experiments in cats demonstrated that METABOND adhesive would provide a very effective and long-lasting method of cementing the titanium magnet 36 to the incus after it was etched with citric acid. The average survival rate of these animals was 9.6 months.

The implant electronics 56 associated with the electromagnetic transducer 40 are designed to apply only push forces on the magnet-incus assembly. Two types of driving coils or electromagnetic transducers were considered; air core and soft magnetic core. The air-core coil was found superior because it does not exert a constant bias force on the ossicular chain. If the system is idling, there is no steady force applied to the incus-magnet assembly. In order to determine the size of the driving coil 40, 20 preserved human cadaver temporal bones were micro surgical dissected. Measurements were made of the mastoid cavity, antrum, attic, and body of the incus. Owing to the anatomic characteristics of the attic, the outside diameter of the driving coil assembled in a titanium case was limited to 5.0 to 6.0 mm. Initially, an efficient coil was built with a 3.0-mm outside diameter, 0.75-mm inside diameter, and a length of 1.0 mm, composed of 2200 turns of 52 AWG copper wire with 600 ohms resistance. A more efficient coil with 2668 turns of 52 AWG copper wire with 875 ohms resistant was later built for short- and long-term animal experimentation. Computer simulations were instrumental in the selection of this coil design.

Figure 7:
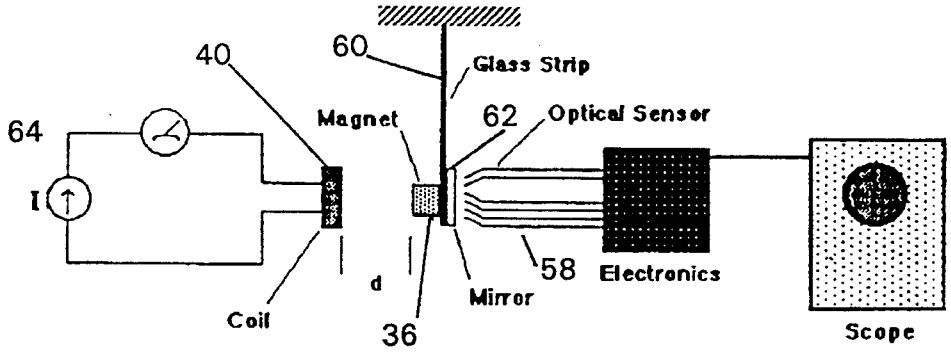
FIG. 7 is a schematic of the test setup used to evaluate the optimal gap between the electromagnet and the permanent magnet.
Figure 8:
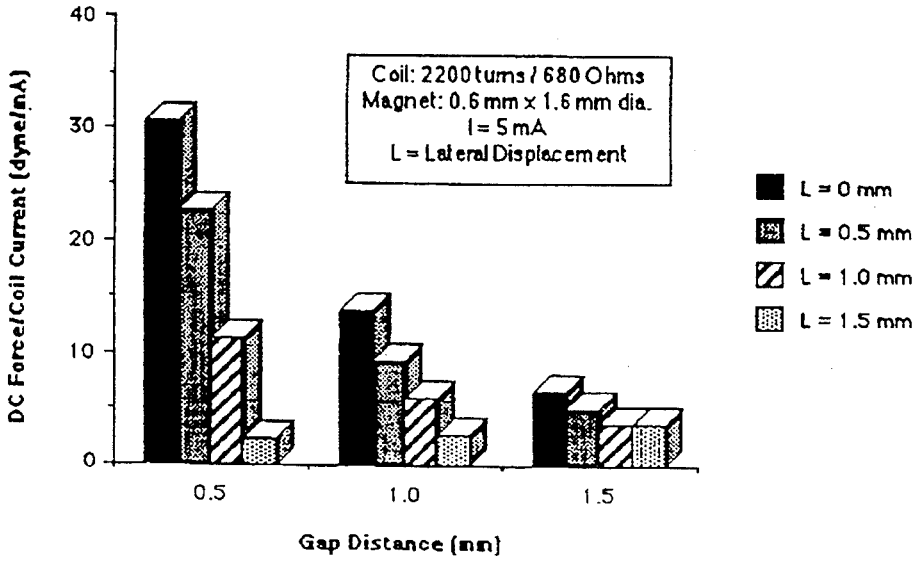
FIG. 8 is a graph of the force of the electromagnet vs. gap derived from the FIG. 7 setup.
Figure 9:
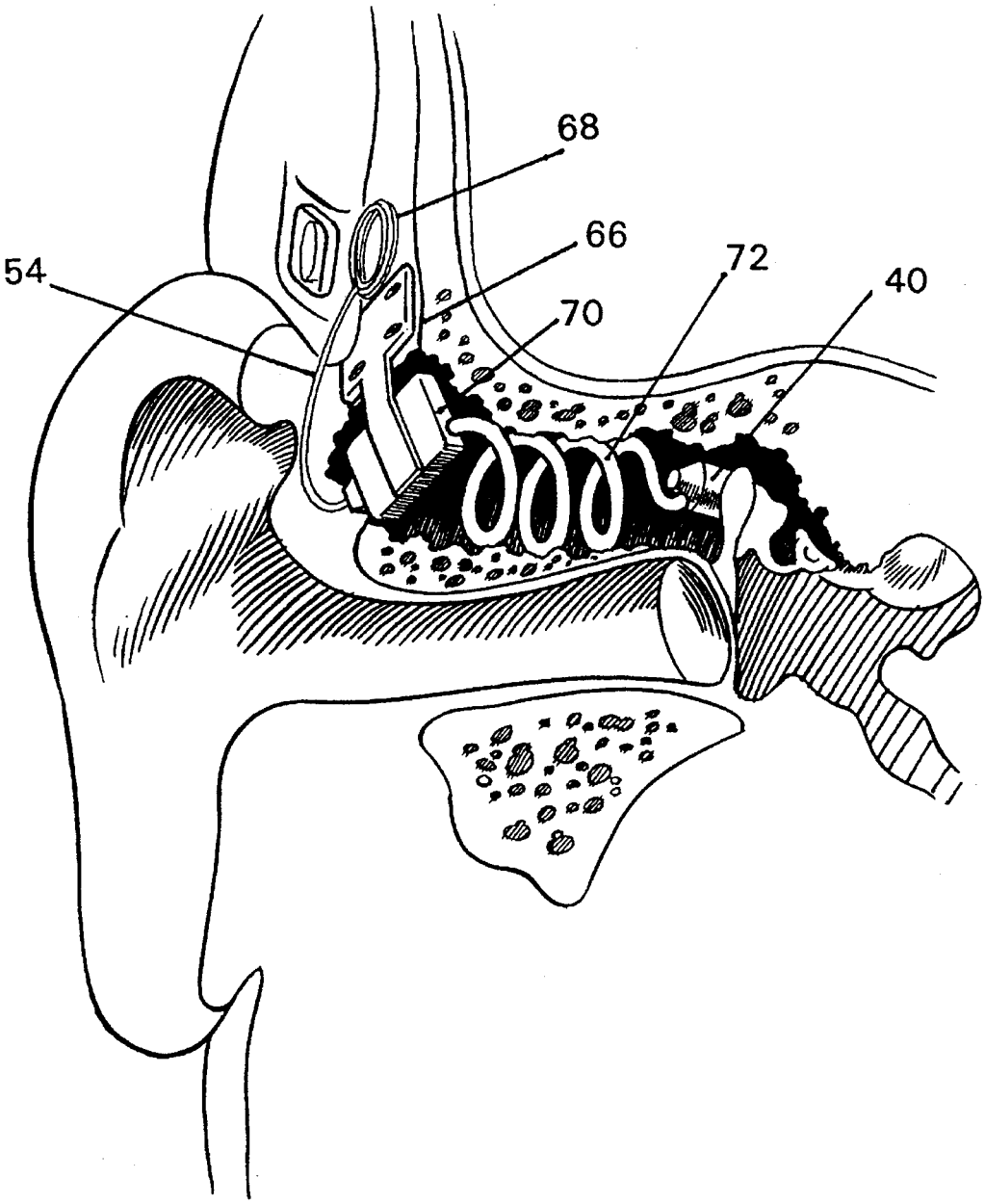
FIG. 9 is a depiction of an alternate support means for mounting the implantable hearing device of the present invention in a human ear.
Figure 10:
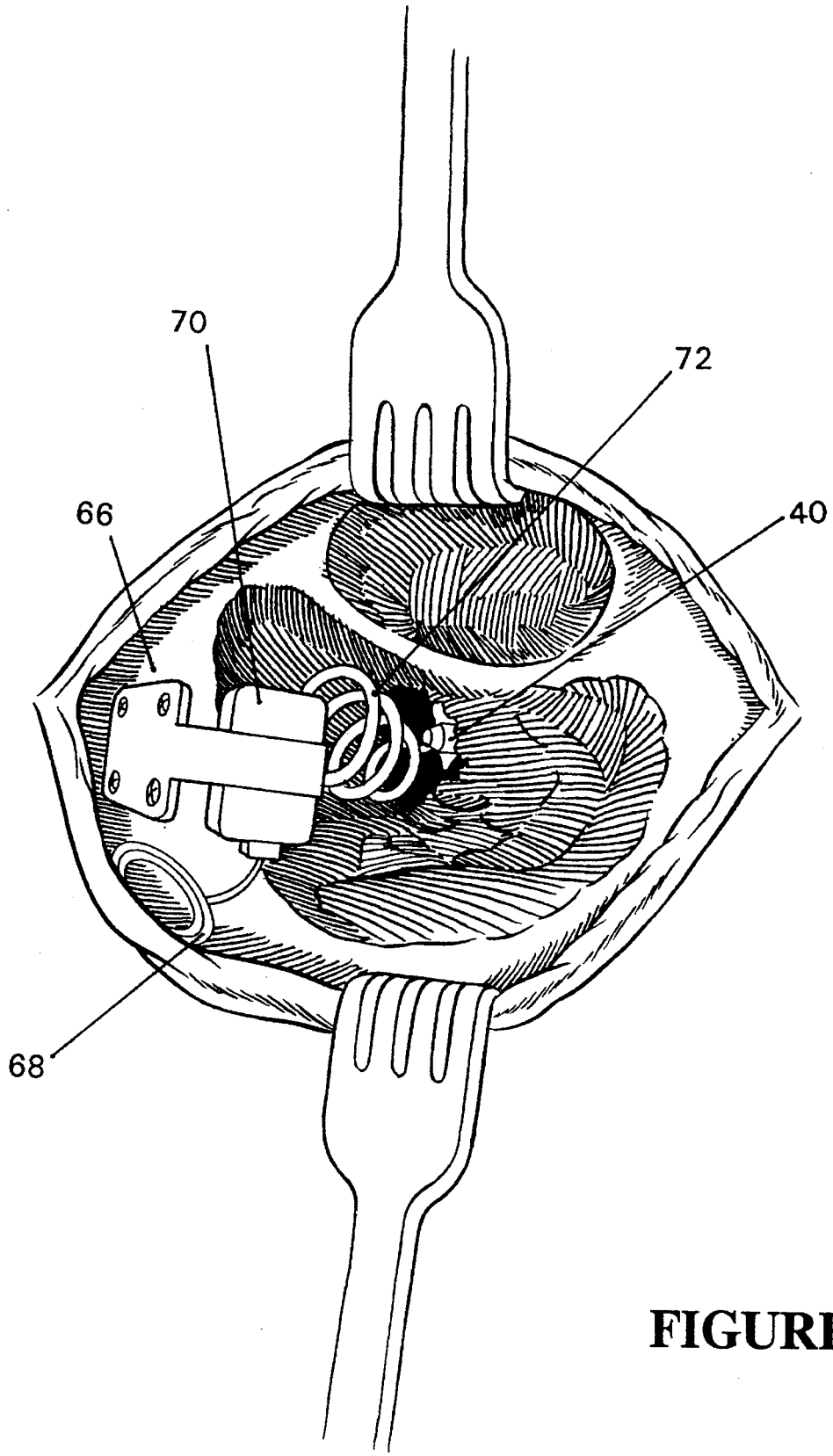
FIG. 10 is an expanded view of the alternate mounting support means of FIG. 9.
Figure 11:
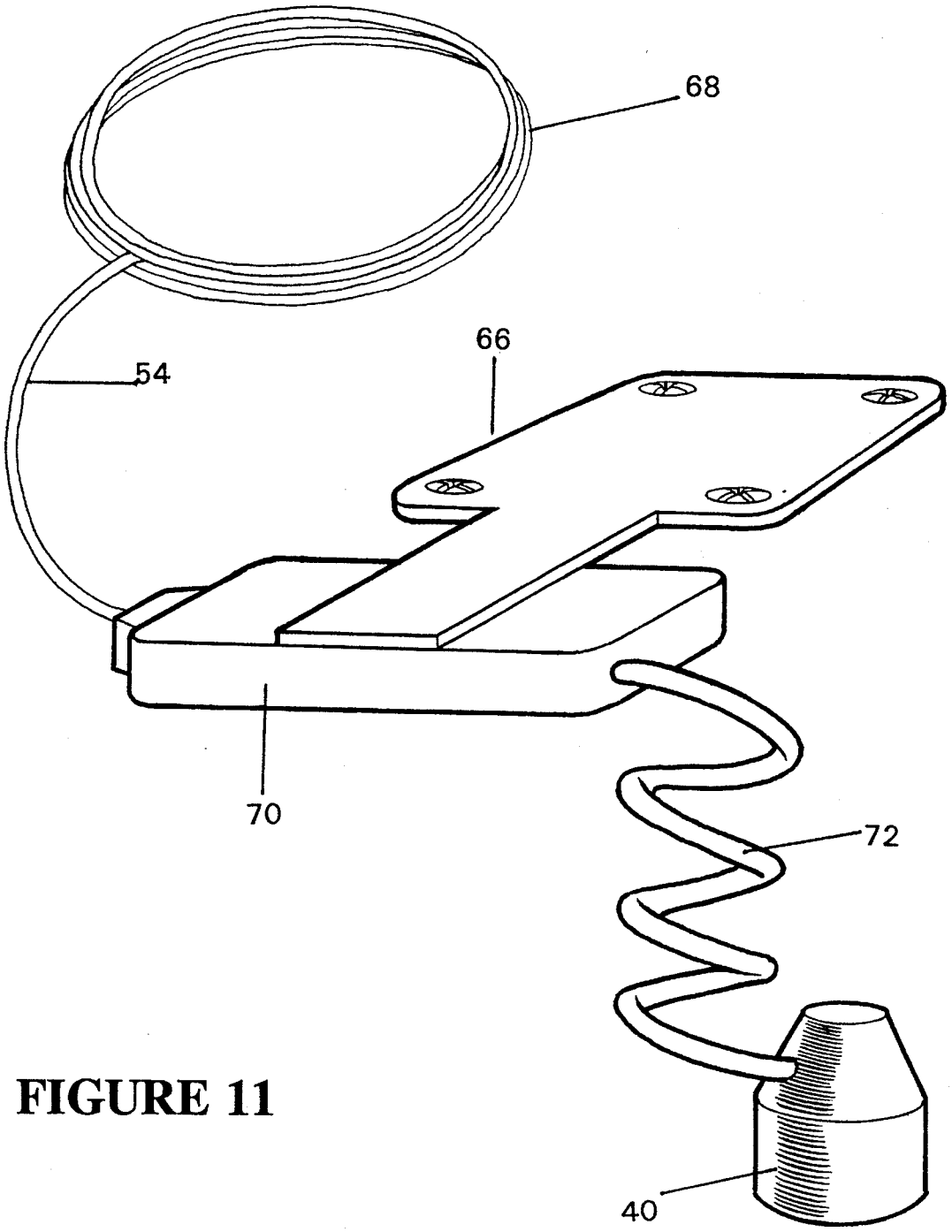
FIG. 11 is an expanded view of the support, antenna, and coil housing of FIG. 10.
Figure 12:
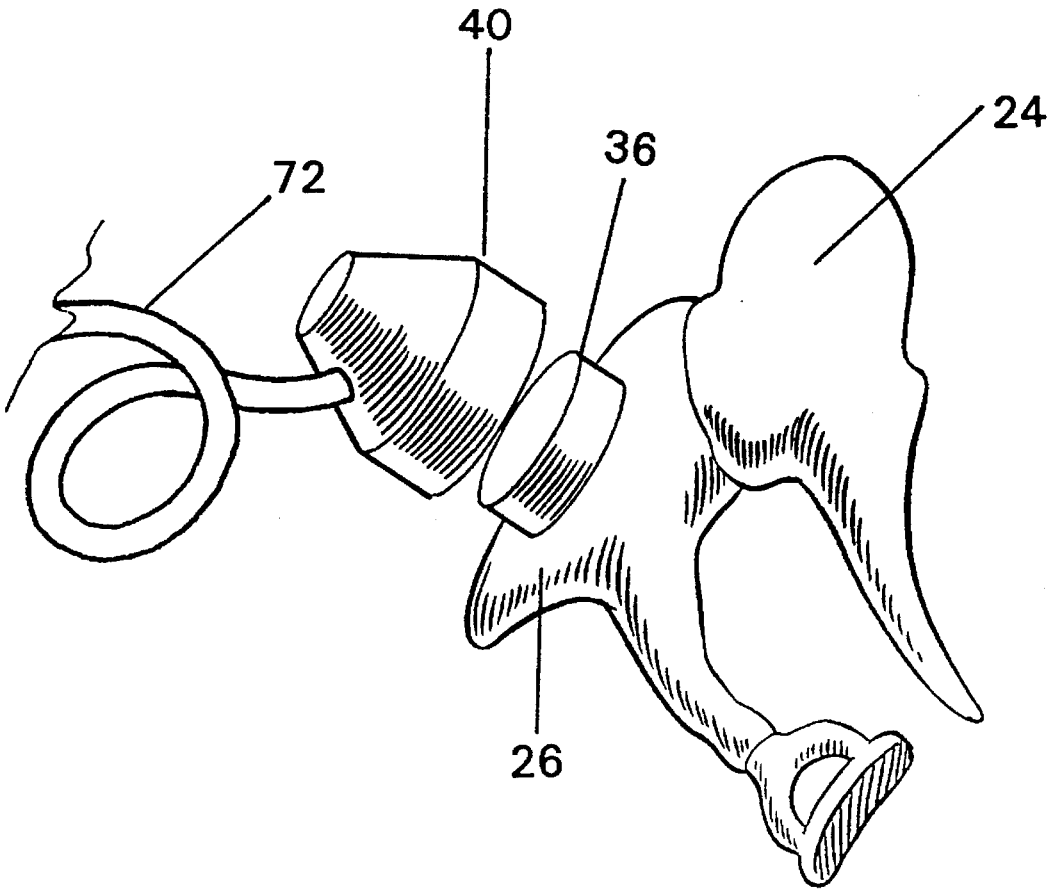
FIG. 12 is an expanded view of the magnet implanted on the end of an asiccular chain with the spaced coil located proximate thereto.
Figure 13:
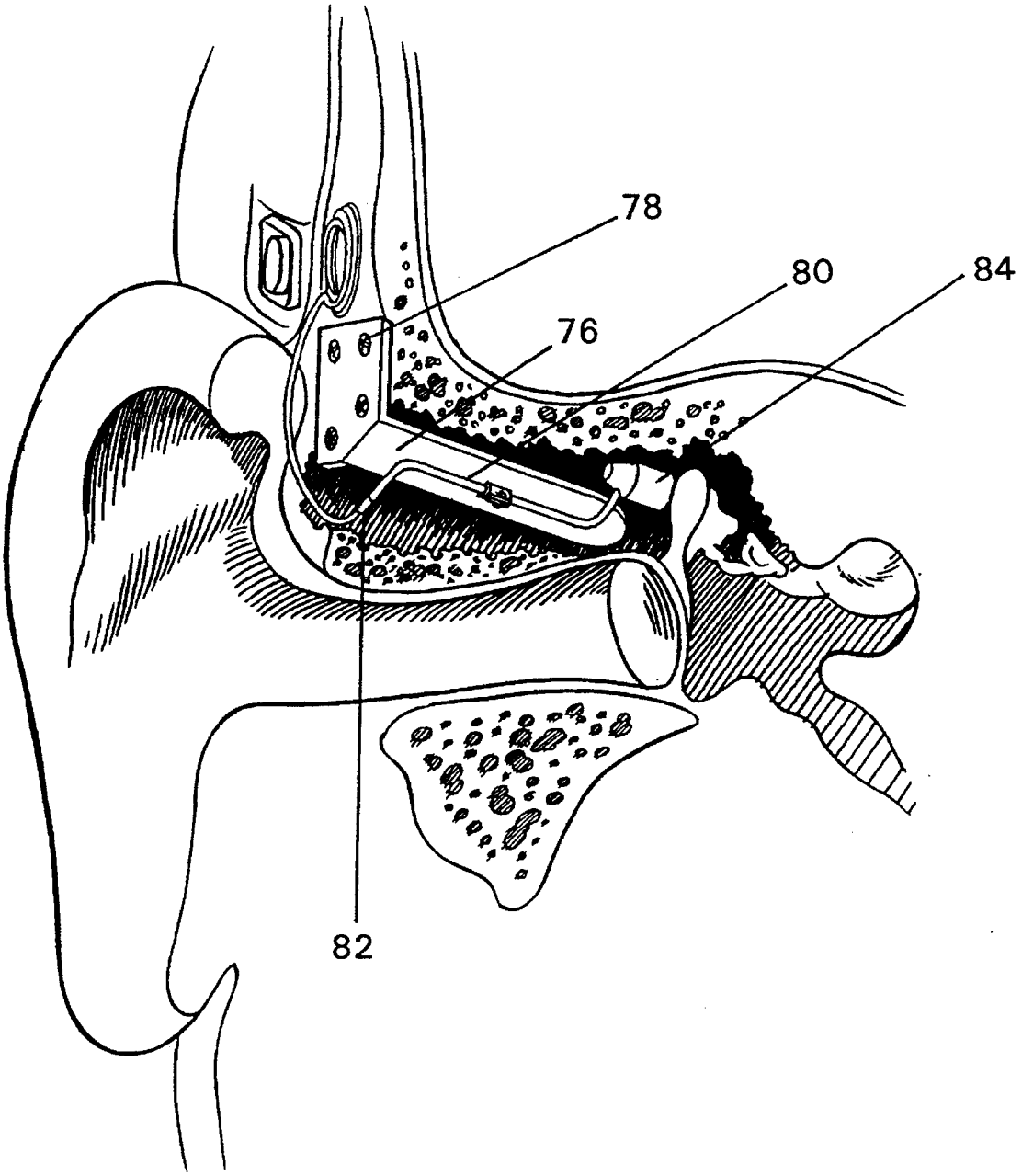
FIG. 13 is a depiction of yet another alternate support means to the FIG. 9. means.
Figure 14:
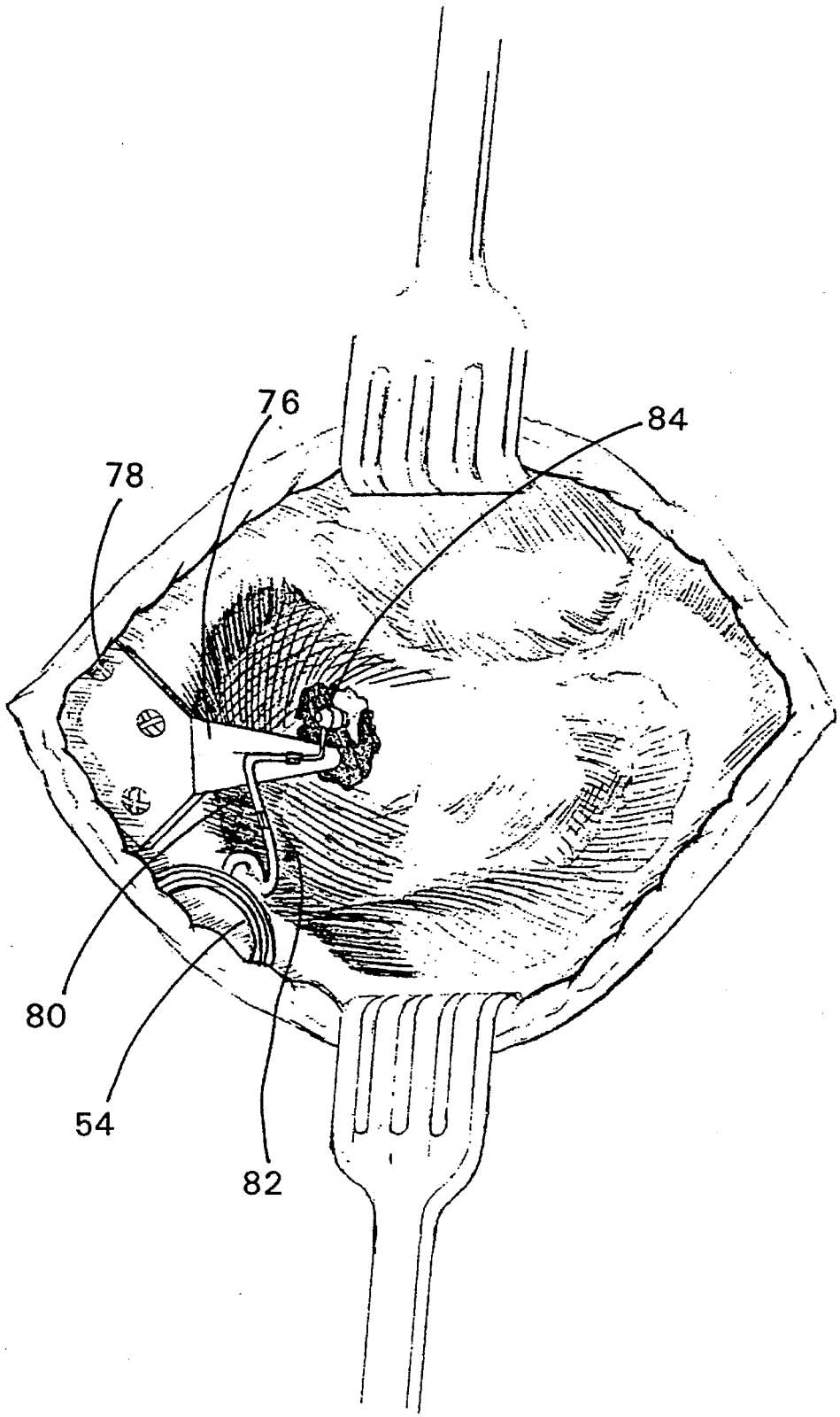
FIGS. 14–18 are expanded detailed views of alternate support means shown in FIG. 13.
Figure 15:
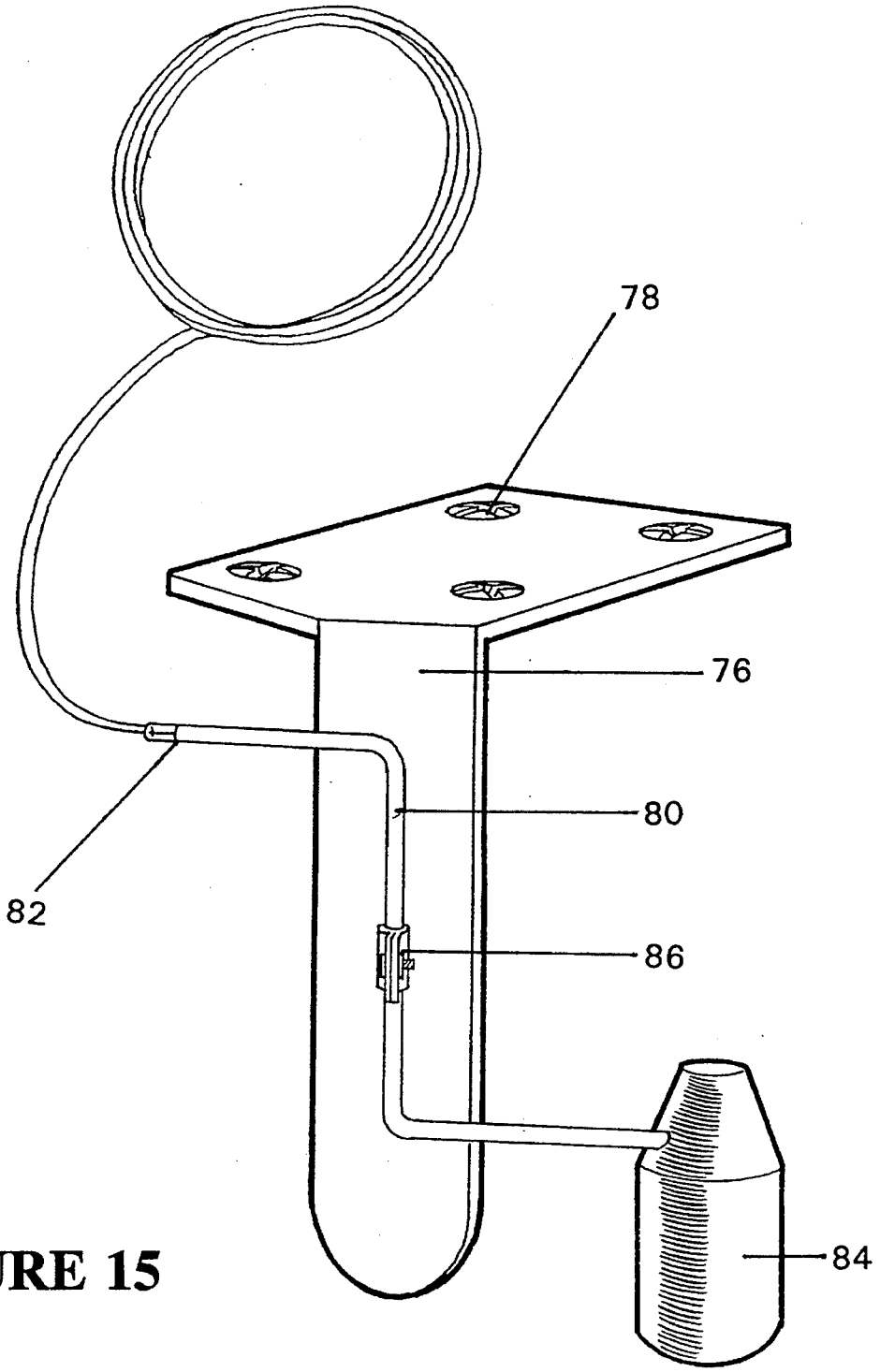
Figure 16:
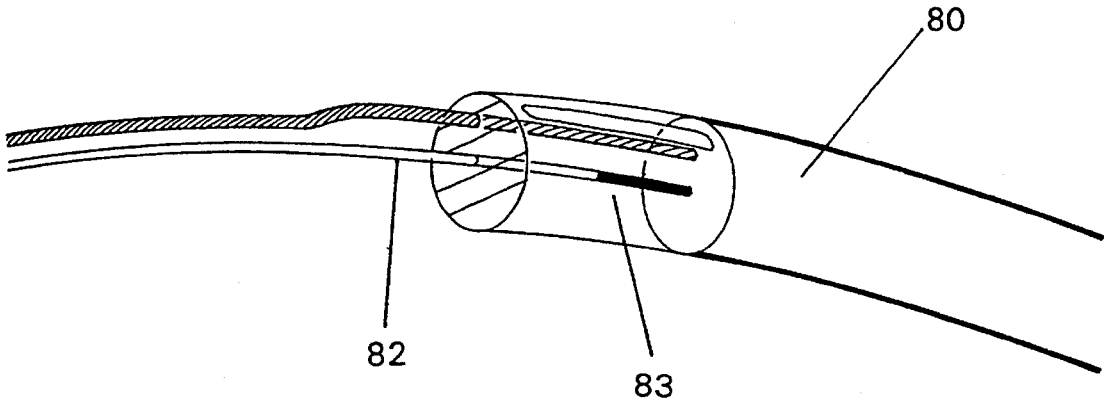
Figure 17:
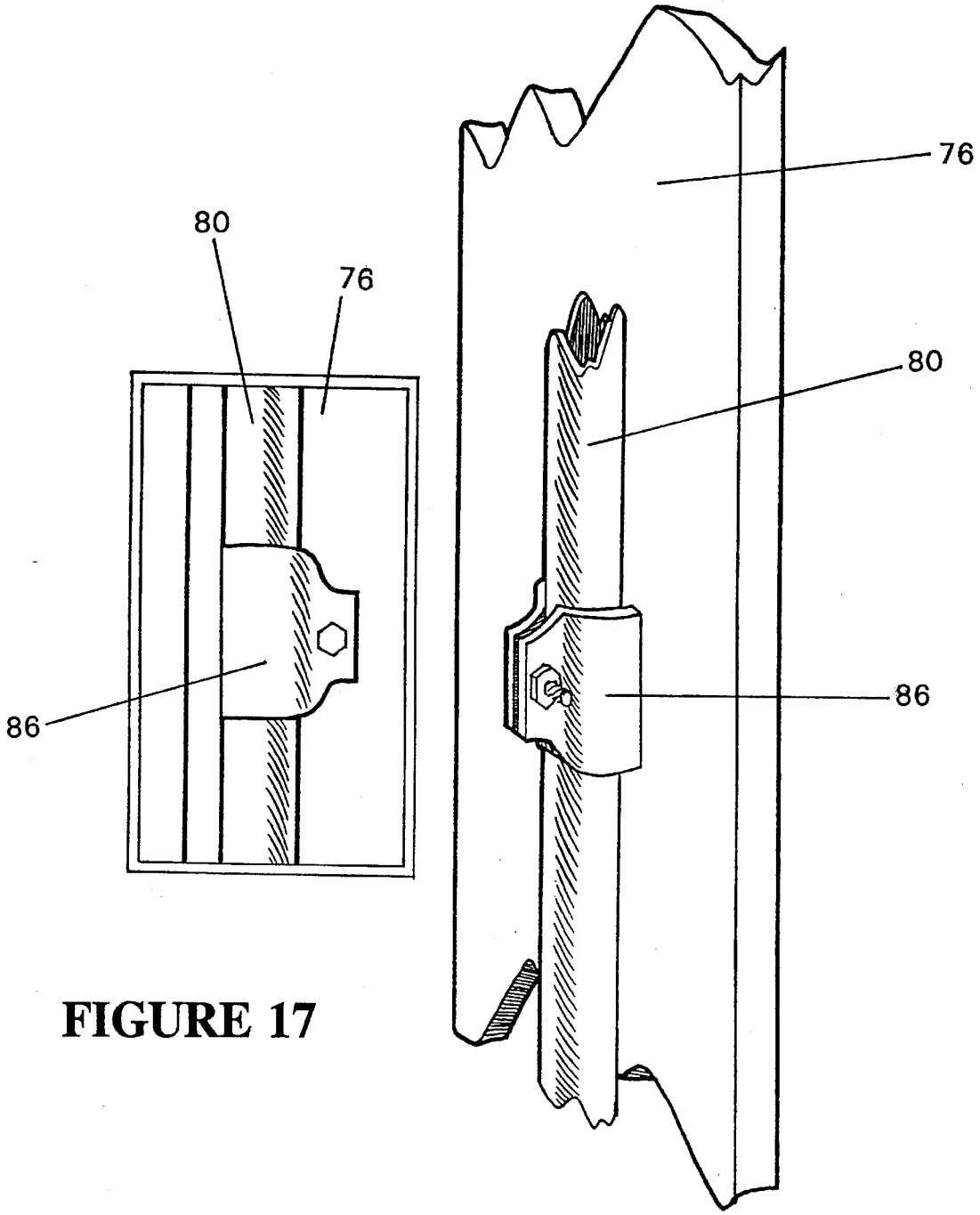
Figure 18:
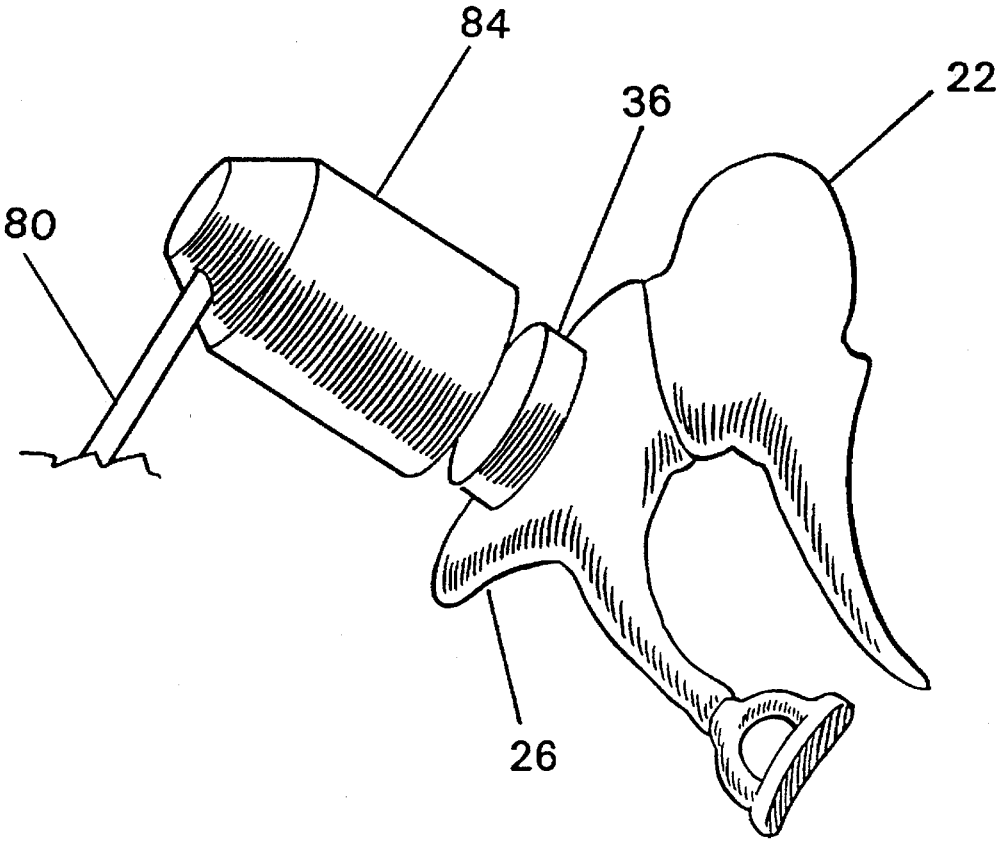

Tests were performed to measure the effect of spatial relationships between the air coil 40 and the NdFeB magnet 36 in a set up best seen in FIG. 7. The DC force per mA was measured using an optical reflection-amplitude sensor 58 and a calibrated cantilevered glass strip 60 as a load cell. This device has a resolution of 0.05 um over a 5 $KH_z$ bandwidth with an accuracy of 10 percent. The NdFeB magnet 36 was affixed to one side of a 0.2 mm thick glass strip and a small mirror 62 was affixed to the opposite side. The air core coil 40 was placed at a known gap distance (d) from the face of the magnet 36 in addition the coil 40 was centered over the magnet. A current source 64 was used to drive the coil 40 and the displacement of the magnet/glass strip assembly was measured at varying gap distances, lateral displacements, and angular variations. With each 0.5 mm increase in gap distance (d), a 50 percent loss in force was noted. Loss in force was negligible for lateral displacements of ±0.5 mm. Force losses became significant at greater lateral distances. Angular variations up to 30° were not found to have a critical effect on the forces generated by the coil which drive the magnet. Experiments showed that no significant reduction of magnetic or frequency response occurred by the interposition of water, albumin, or serous otitis media glue material bridging the air space between the coil and the magnet attached to the incus. There is a steady force acting between the components due to surface tension of the glue from middle ear interfaced in the gap, more so at high frequency (10 $KH_z$). From the results summarized at FIG. 8. it is thus seen that the gap d must be maintained at approximately 1 mm to prevent significant loss of signal from the electromagnet 40.

Figure 3:
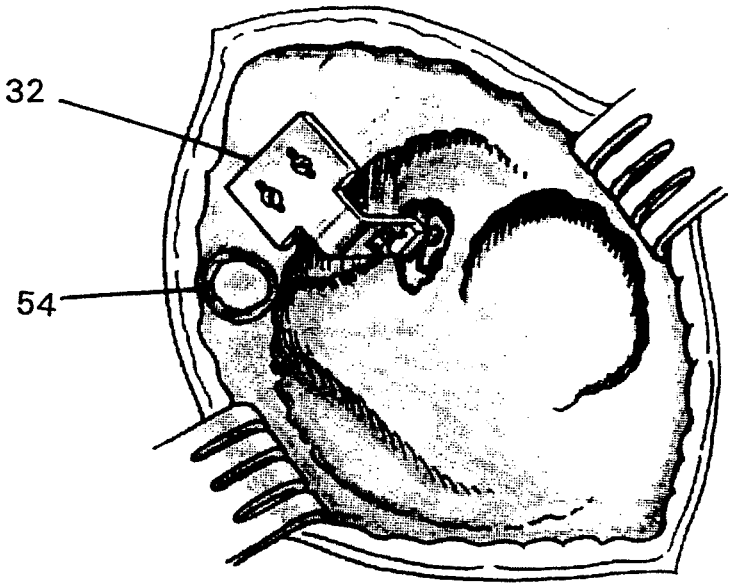
FIG. 3 is an expanded view of the support means and receiving antenna of the FIG. 1. depiction.
Figure 4:
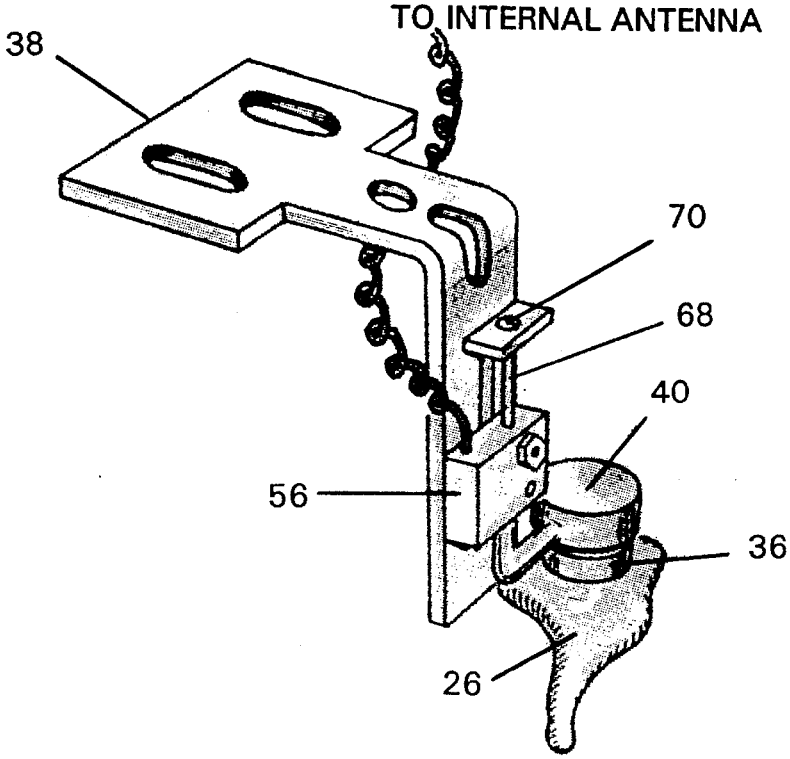
FIG. 4 is an expanded view of the support means of the FIG. 1 depiction.

To obtain this desired gap during the implanting of the internal assembly 32, the surgeon mounts the retaining number 38 to the temporal bone through screw fasteners 66 best seen in FIG. 3. The internal antenna 54 is encased in an overlapping Silicon Dacron mesh envelope (not shown) and this envelope is sutured with Nylon to the area of the temporal bone which will align the internal antenna 54 with the external antenna 48 of the unit 34 when located in the pocket 50. As seen in FIG. 4. the electronics case 56 is movably mounted on a threaded shaft 68 and moves up and down that shaft 68 in response to the rotation thereof. The head 70 of the shaft 68 is slotted and with the retainer assembly 32 mounted, the surgeon rotates the shaft 68 until the electromagnet 40, which is ridgedly affixed to the case 56, rests against the permanent magnet 36. The threads are calibrated to have a predetermined vertical movement per 360° turn of the head 70. The head is then rotated a predetermined number of turns corresponding to a 1 mm vertical movement of the case 56. Alternatively the gap could be physically measured.

Referring now to FIGS. 2–9. an alternate form of internally mounted support assembly 66 may be seen. This assembly 66 has the internal antenna 54 of FIG. 1. encased in a Silicon Dacron cloth cover 68 electrically connected to a sealed case 70 containing the implant electronics 56 shown in FIG. 5. The sealed air core drive coil 40 is electrically connected to the electronics 56 through an electrically insulated electrical wire encased in a Titanium tube formed as a spiral wound semi-rigid coil 72. The 1 mm spacing between the coil 40 and the magnet 36 is provided by having the surgeon mount the assembly 66 to the temporal bone through mounting bracket 74 in a manner similar to the mounting of the FIG. 1. assembly. The surgeon then contracts or expands the spiral coil 72 until a measured space of 1 mm is achieved between the drive coil 40 and the magnet 36.

FIGS. 13 through 18 show yet another alternate mounting of the internal implant electronics and drive coil to maintain the needed 1 mm spacing between the coil 40 and magnet 36. Here, a mounting bracket 76 is provided in the form of an L with mounting holes 78 for mounting the bracket 76 to the temporal bone by known means. A "Z" shaped semi-rigid member 80 has electrical wires 82 from the receiving coil 54 extending these through to a sealed insulated case 84 containing the implant electronics 56 and the drive coil 40.The electric wire 82 is laser welded to a platinum feedthrough 83 which is glass insulated. The Z shaped member 80 is moved by the surgeon along the bracket 76 until the case 84 is 1 mm from the magnet 36 at which time the Z member 80 is pressed firmly between tabs 86 on the bracket 76 to maintain the mentioned spacing. The advantage of this assembly 76 over the coil 72 is that any possibility of actuating the resonant frequency of the coil 72 is eliminated. Also, a diode-capacitor chip and a driving electromagnetic coil are encased in a Titanium case 84. This eliminates the need for the electronic case 70 shown in the FIG. 9 embodiment.

Figure 19:
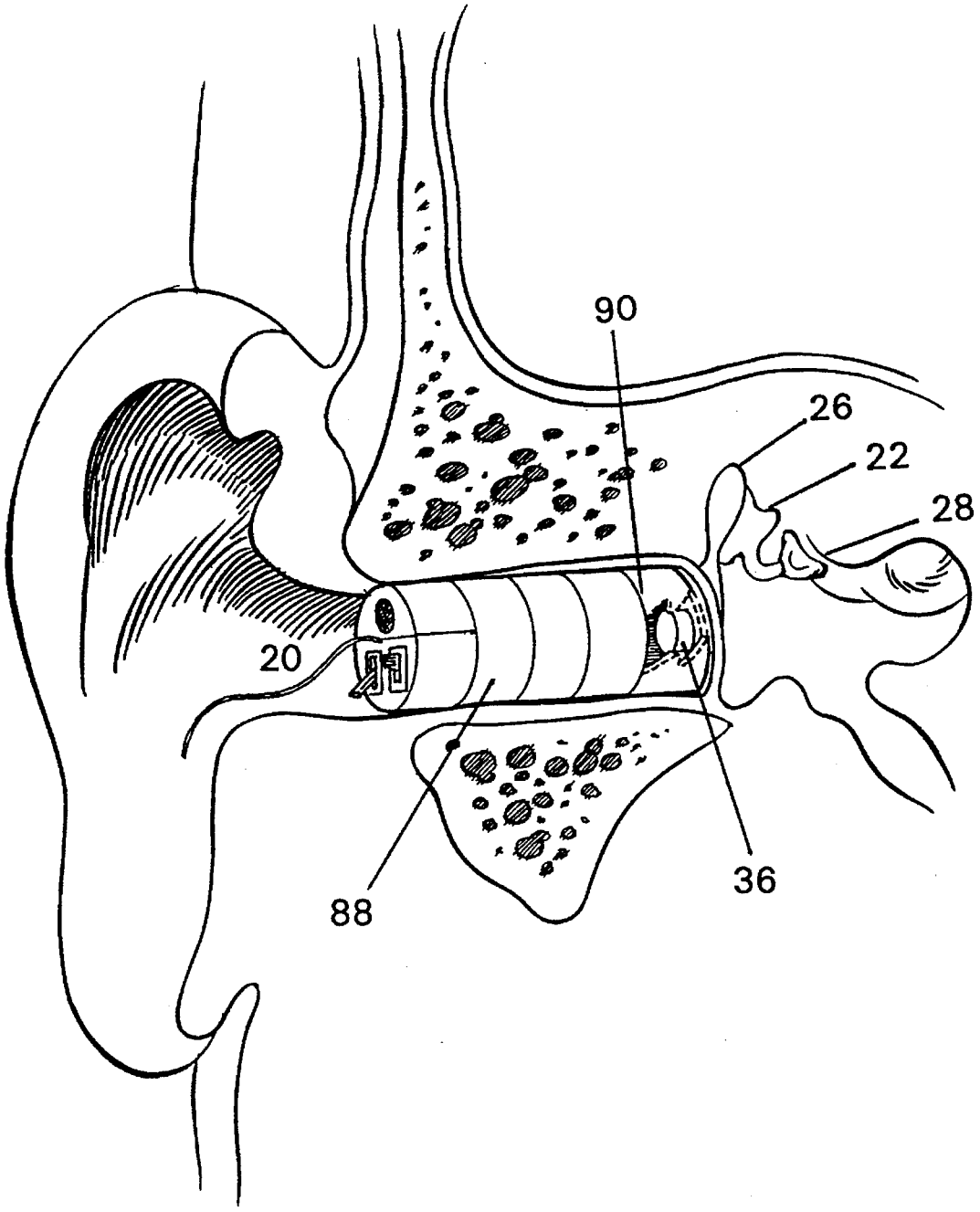
FIG. 19 is a depiction of an alternate mounting of the partially implantable hearing device of the present invention.
Figure 20:
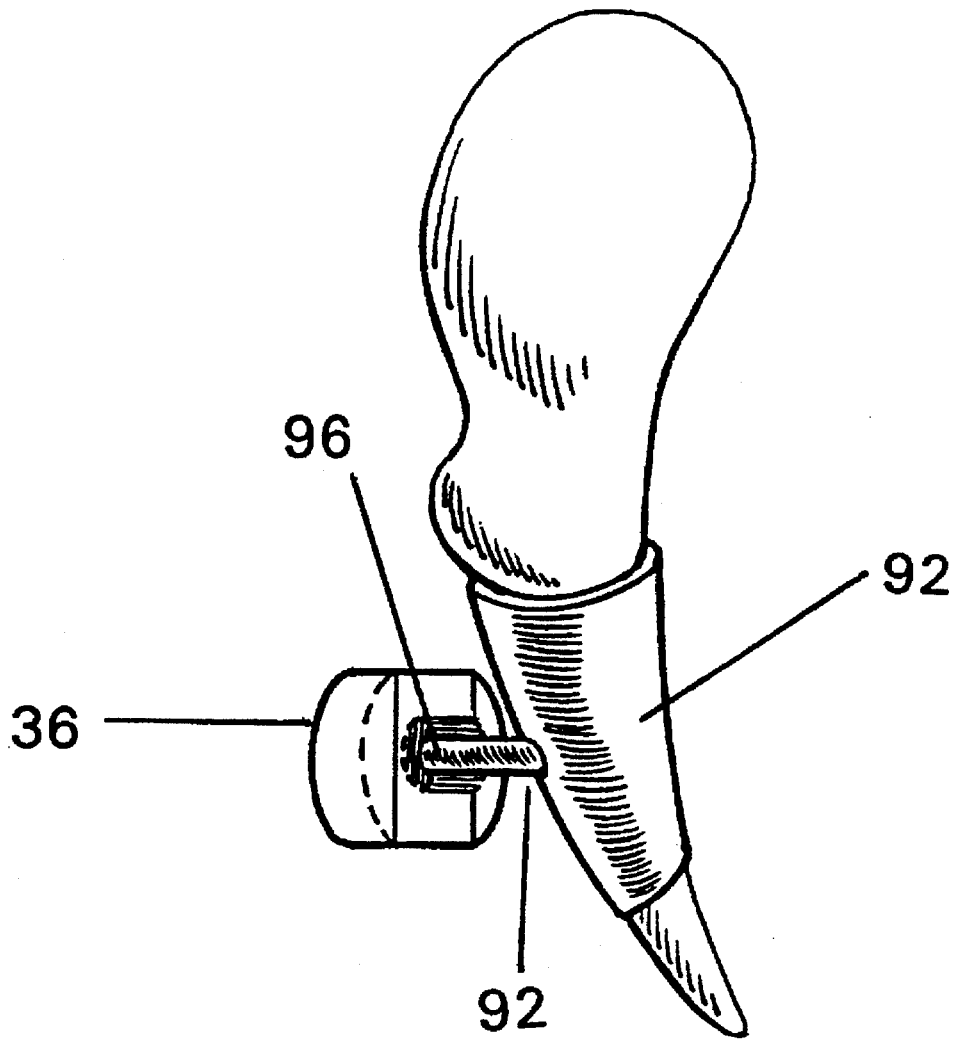
FIGS. 20–21. are expanded views of the FIG. 19. showing.
Figure 21:
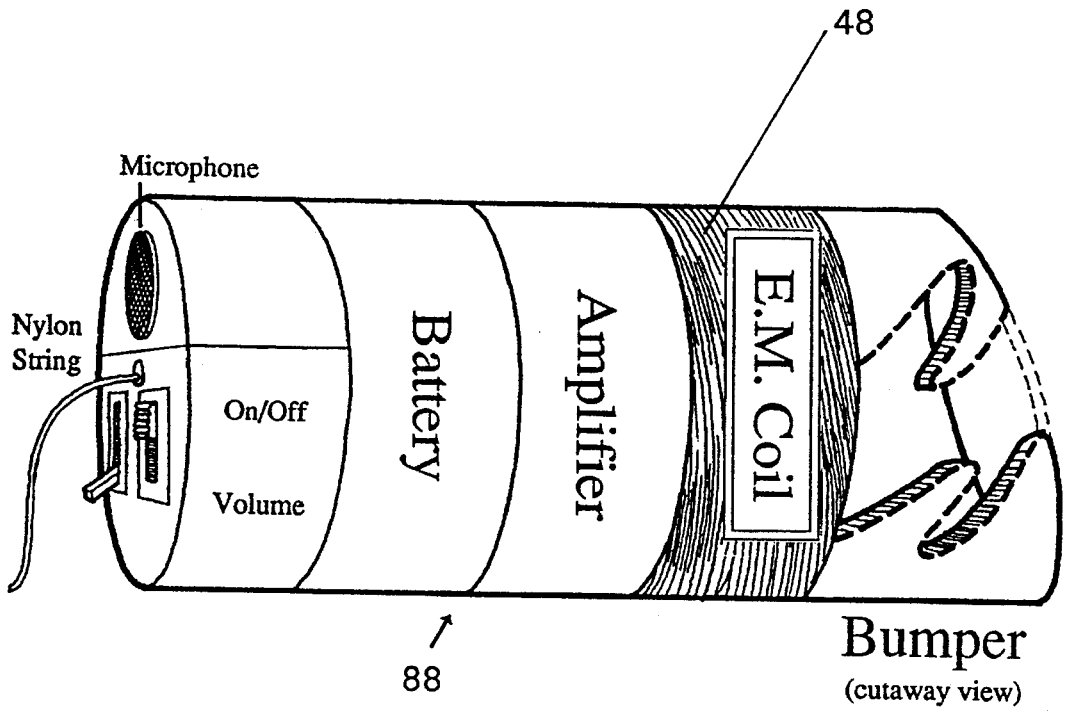

In FIG. 19 through 21 an ear canal 20 hearing aid unit 88 is shown which has the external unit microphone, amplifier and driving coil basically reconfigured as a plug-in tube having an open end with back-off tabs 90 which maintain the air core electromagnetic coil 48 1 to 2 mm. away from the permanent magnet 36 which is mounted to the malleus 26. In this embodiment, the malleus 26 has a plate 92 "attached by METABOND adhesive" thereto. The plate 92 has a past 94 which fits into a depression 96 formed in the encased magnet 36 and is "attached by METABOND adhesive" therein. The air core electromagnetic coil 48 is made stronger by providing a 3,800 turns.

Figure 22:
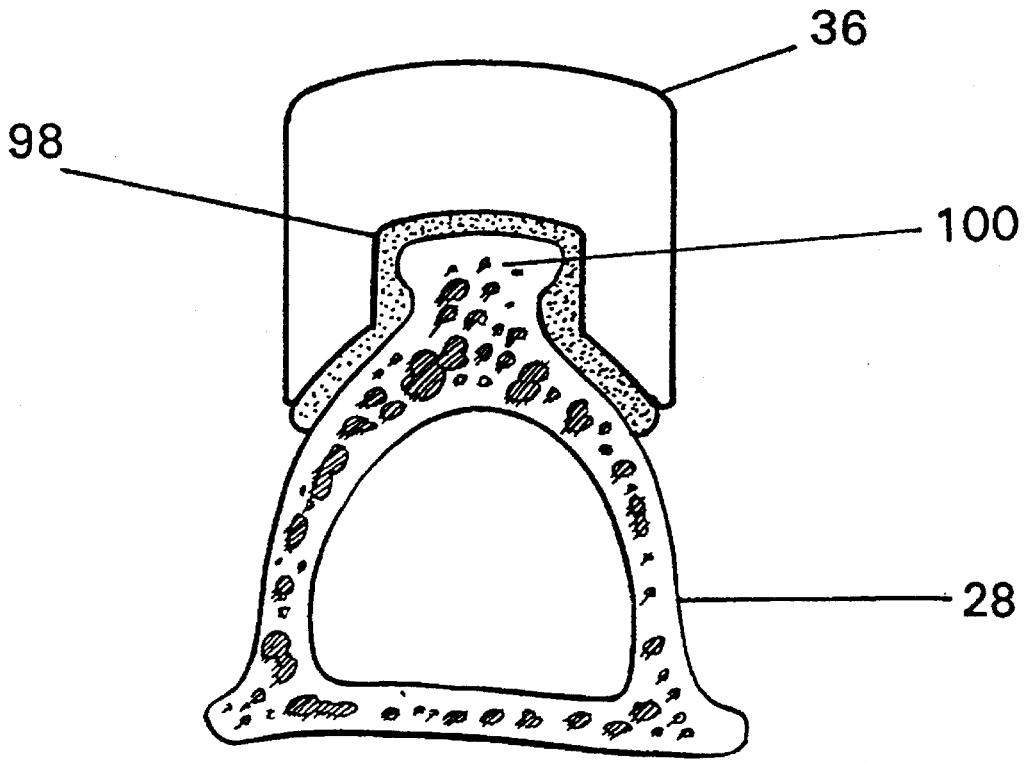
FIG. 22. is a depiction of the mounting of the permanent magnet to the stapes of the ossicular chain for the FIGS. 13 and 19 mounted hearing devices.

In certain cases, the sealed magnet 36 may have to be mounted to the stapes of the ossicular chain as seen in FIG. 22. Due to pathological conditions or diseases the malleus and incus may be absent. In these cases, an opening 98 is formed in the sealed magnet 36 compatible with the head 100 of the stapes 28 and the head 100 is "attached by METABOND adhesive" therein.

Certain improvements and modifications will be obvious to people of ordinary skill in the art area. It will be understood that they have been deleted herein for the sake of conciseness and readability but are fully intended to be within the scope of the following claims.

What is claimed is:

1. A partially implantable hearing device comprising:

a high coercivity permanent magnet of 10.6 KOe or higher enclosed within a hermetically sealed case having a helium atmosphere therein and adapted to be mounted on the ossicular chain of a middle ear;

an electromagnet;

means for mounting said electromagnet a predetermined distance from said permanent magnet in a contactless manner;

means adapted to be mounted external of the ear for translating acoustic signal into electrical signals; and means mounted on said mounting means for receiving said electrical signals from said translating means and sending them to said electromagnet to actuate same in response thereto.

2. A hearing device as set forth in claim 1 wherein said permanent magnet is a Neodymium-iron-born (NdFeB) material magnet.

3. A hearing device as set forth in claim 1 wherein said case is made of titanium material.

4. A hearing device as set forth in claim 1, wherein said electromagnet is mounted approximately 1 mm away from said permanent magnet.

5. A hearing device as set forth in claim 4, wherein said electromagnet is an air core electromagnet having approximately 2,200 turns of 52 AG cooper wire having a resistance of approximately 600 ohms.

6. A hearing device as set forth in claim 4, wherein said electromagnet is an air core electromagnet having approximately 2,668 turns of 52 AG cooper wire having a resistance of approximately 875 ohms.

7. A hearing device as set forth in claim 4, wherein said electromagnet is an air core electromagnet having approximately 3,800 turns of 52 AG cooper wire having a resistance of approximately 1415 ohms.

8. A hearing device as set forth in claim 5, wherein said electromagnet is a coil of approximately 3 mm outside diameter and 0.75 mm. inside diameter.

9. A hearing device as set forth in claim 1, wherein said permanent magnet is adapted to be bonded to said ossicular chain with a biocompatible adhesive.

10. A hearing device as set forth in claim 9, wherein said adhesive is a class II dental adhesive.

11. A mounting member for mounting an electromagnet a predetermined optimal distance from a target permanent magnet mounted to the ossicular chain of the middle ear in a partially implantable hearing device comprising:

an internally implanted antenna;

an electromagnet;

a sealed biocompatible container having electrical components therein electrically connected to said antenna for converting signals from said antenna into electrical signals for said electromagnet;

a semi-rigid coil connected to said electromagnet at one end and to said container at the other end having an insulated connecting wire therein for connecting said electrical components to said electromagnet; and said coil being vertically extendable to allow vertical positioning of said electromagnet with respect to said target permanent magnet.

12. A mounting member as set forth in claim 11, including a tab having 45° angles thereon and mounting holes therein adapted for mounting said sealed container to the temporal bone.

13. A partially implantable hearing device comprising;

a high coercivity target permanent magnet of 10.6 KOe or higher adapted to be mounted to an ossicular chain of the middle ear;

an electromagnetic assembly adapted to be spacedly mounted within the ear canal a predetermined distance from said target permanent magnet; and spacing members located at one end of said electromagnet assembly adapted for resting against the tympanic member of the middle ear and the skin of the external ear canal with the electromagnet as said assembly maintained at the predetermined optimal distance whenever said electromagnetic assembly is fully inserted into the ear canal.

14. A hearing device as set forth in claim 13 wherein said permanent magnet is bonded to a post extending from a titanium metal plate adapted to be mounted to the malleus of the ossicular chain.

15. A hearing device as set forth in claim 13 wherein said target permanent magnet is adapted to be bonded to the head of the stapes bone of the ossicular chain.

16. A hearing device as set forth in claim 15 wherein said target permanent magnet is adapted to be bonded to the head of the stapes bone of the ossicular chain by a class II dental adhesive.

17. A partially implantable hearing device comprising:

a high coercivity permanent magnet of 10.6 KOe or higher adapted to be mounted on the ossicular chain of a middle ear;

an electromagnet;

means for mounting said electromagnet a predetermined distance from said permanent magnet in a contactless manner;

means adapted to be mounted external of the ear for translating acoustic signal into electrical signals including a sealed assembly adapted to be concealably mounted behind the ear comprising a microphone, a battery, a modulator, a radio frequency amplifier and a transmitting antenna;

means mounted on said mounting means for receiving said electrical signals from said translating means and sending them to said electromagnet to actuate same in response thereto;

wherein said electromagnetic mounting means includes a rigid member adapted to be mounted to a mastoid bone and a receiving antenna located opposite of said transmitting antenna with a demodulating unit being physically mounted to said rigid member and electrically connected to said receiving antenna and said electromagnet to actuate said electromagnet in response to the signals received by said receiving antenna; and wherein said rigid member includes means for moving said electromagnet along said rigid member to a predetermining distance from said permanent magnet.

18. A hearing device as et forth in claim 17 wherein said moving means includes a housing rigidly connected to said electromagnet and having said demodulator enclosed therein with a threaded shaft extending there through to vertically move said housing along said rigid member in response to rotation of said shaft.

19. A hearing device as set forth in claim 17 wherein said demodulator is encased with said electromagnet and including a Z shaped member connected to said encased demodulator and electromagnet with said Z shaped member being pressed to said rigid member between tabs located thereon to retain a desired space between said electromagnet and said target permanent magnet.

* * * * *